United States Patent [19]

Drucker

[11] Patent Number: 5,025,640

[45] Date of Patent: Jun. 25, 1991

[54] REFRIGERANT EXPANSION DEVICE FOR OPTIMIZING COOLING AND DEFROST OPERATION OF A HEAT PUMP

[75] Inventor: Alan S. Drucker, DeWitt, N.Y.

[73] Assignee: Carrier Corporation, Syracuse, N.Y.

[21] Appl. No.: 544,576

[22] Filed: Jun. 27, 1990

[51] Int. Cl.[5] ..... F25B 13/00

[52] U.S. Cl. ..... 62/324.6; 62/324.1; 62/222; 62/528; 137/493.8

[58] Field of Search ..... 62/324.1, 324.6, 528, 62/222, 224; 137/493.8, 513.3

[56] References Cited

U.S. PATENT DOCUMENTS 3,404,542 10/1968 Fineblum ..... 62/324.6

4,341,090 9/1982 Ramakrishnan ..... 62/324.6

*Primary Examiner*—Henry A. Bennett

*Assistant Examiner*—John Sollecito

*Attorney, Agent, or Firm*—Frederick A. Goettel, Jr.

[57] ABSTRACT

A refrigerant expansion device for use in a refrigeration system includes a body having a flow passage extending therethrough. A piston having a flow metering port therethrough is moveably mounted within the flow passage. A flow metering rod is supported within the housing and extends through the flow metering port. The flow metering rod and the flow metering port cooperate to define a flow metering passage between them. The flow metering rod is configured so that the cross sectional area of the metering passage varies relative to the axial position of the piston with respect to the rod. The piston is spring biased and the piston moves relative to the rod as a function of the pressure differential across the piston. The cross sectional area of the flow metering rod is configured to define a defrost metering zone which cooperates with the metering port to provide a defrost flow metering passage, at pressure differentials lower than the normal pressure differential for cooling operation of a system in which the device is to be installed. The defrost metering passage is substantially larger than the flow metering passage required for normal cooling operation of the refrigeration system.

2 Claims, 2 Drawing Sheets

REFRIGERANT EXPANSION DEVICE FOR OPTIMIZING COOLING AND DEFROST OPERATION OF A HEAT PUMP

BACKGROUND OF THE INVENTION

1. Field of the Invention

This invention relates in general to refrigerant expansion devices for use in heat pump systems. More specifically, this invention relates to an expansion device that has a variable expansion area operated by the pressure differential between the high and low sides of a heat pump system and which is capable of providing an optimum expansion area in both the cooling and defrost modes of operation.

2. Description of the Prior Art

Conventional heat pumps include a refrigeration circuit with a compressor and indoor and outdoor heat exchanger coils which function alternately as a condenser and an evaporator in response to a thermostat controlled valve which reverses the direction of refrigerant flow through the circuit between heating and cooling cycles. During cooling cycles the indoor coil functions as an evaporator, absorbing heat from indoor air, and the outdoor coil functions as a condenser, rejecting heat into the outdoor air.

During heating cycles the outdoor coil functions as an evaporator absorbing heat from the outdoor air, and the indoor coil functions as a condenser rejecting that heat to the indoor air for comfort heating. During the time outdoor temperatures are around 45 degrees, and colder, moisture from the outdoor air is collected onto the outdoor coil fins in the form of frost. The frost accumulates progressively in thickness on the fin surfaces thereby reducing heat transfer by blocking air flow therethrough, and by its insulating effect on the fin surfaces.

The frost accumulation is periodically removed by temporarily operating the heat pump in a cooling cycle wherein hot gas discharged from the compressor is circulated to the outdoor coil to heat it for frost removal. A defrost cycle is functionally a temporary cooling cycle. It is common practice to initiate defrost cycles by automatic means responsive to the thickness of frost accumulation, or by an interval timer. Termination of defrost cycles are typically caused by a thermostat which senses temperature rise of the outdoor coil, or its condensate, indicating completion of frost removal.

Each heat pump coil is usually provided with its own expansion device operative during the time the coil is serving as an evaporator. The device serving the outdoor coil, in heating cycles, provides for metering liquid refrigerant to efficiently meet the circumstances of evaporation during a range of cold outdoor winter temperatures. For example, at a winter ambient of 25 degrees F. the evaporating pressure in the outdoor coil would be approximately 35 PSIG, and the condensing pressure in the indoor coil 195 PSIG, establishing a pressure difference across the expansion device of 160 PSI.

The expansion device serving the indoor coil during the summer cooling cycles is selected to meter liquid refrigerant to the indoor coil during a range of summer cooling temperatures. As an example, at 85 degrees F. ambient, the condenser pressure in the outdoor coil would be approximately 250 PSIG, while the evaporating pressure in the indoor coil would be in the range of 72 PSIG, establishing a pressure difference across the expansion device of 178 PSI.

When a defrost cycle is initiated, refrigerant flow is reversed and circulation of refrigerant in the cooling direction is caused to occur for a set time period, or until a set temperature at the outdoor coil, for example: 80–85 degrees F., is reached. During defrost operation energy penalties are paid which reduce the operating efficiency of the heat pump system. Specifically, during defrost, electrical energy is being consumed by the refrigeration system to defrost the coil with no resultant mechanical heat from the heat pump system being transferred to the heated area. During defrost, heat is actually being removed from the heated area and transferred to the outdoor coil to melt the frost. Further, during the time of defrost, generally, an electric resistance back up heating system installed in the duct work is actuated to maintain the heated space at a desired comfort level. As a result, it is evident that, it is extremely desirable to minimize the defrost time of a heat pump system in order to increase the operating efficiency of the system. One common measure of the efficiency of a heat pump system is the Heating Seasonal Performance Factor, commonly referred to as HSPF. This term is defined by the U.S. Department of Energy as "The total heating output of a heat pump during its normal annual usage for heating divided by the total electric power input during the same period."

Accordingly, since the electrical input is far more efficient when providing heat through the heat pump system, it is extremely desirable to minimize the length of the defrost cycle.

Typical heat pumps are designed with greater outdoor coil volume than indoor coil volume. This is done to maximize cooling performance which is typically the major selling feature or purpose of the heat pump. As a result, the circulated refrigerant charge quantity is greater during the cooling cycle than the heating cycle.

Upon initiation of defrost, a heat pump is shifted from a heating cycle to a cooling cycle. One factor affecting the length of the defrost cycle is the time required to get into circulation, the proper amount of refrigerant charge to maximize heat transfer from the conditioned space to the cold frosted outdoor coil. When a defrost cycle is initiated, by establishing a temporary cooling cycle under typical winter ambient conditions, the condensing pressure in the outdoor coil is the maximum pressure available for delivering refrigerant from the outdoor coil to the indoor coil through the cooling expansion device. Under such circumstances, the cooling expansion device exhibits a high resistance to flow thereacross because it is designed to control refrigerant flow under a pressure differential in the range of 178 psi as shown in the example given above. Under such circumstances, the compressor is usually required to reduce the pressure in the indoor coil to less than zero to establish a pressure differential capable of feeding the indoor coil. In some systems, under certain circumstances, a satisfactory defrost cycle cannot be accomplished with the cooling expansion device serving as the defrost expansion valve.

It has been recognized that during defrost operation, the difference between the high and low pressure in a heat pump system is so small that optimal refrigerant circulation is not guaranteed. One approach to solving this problem has been to provide a solenoid actuated bypass arrangement which provides a large, very low resistance, path bypassing the cooling expansion valve during defrost operations. The theory behind such a bypass valve is to "carry out defrosting as quickly as possible". In practice, however, it has been found that upon initiation of defrost, a low resistance bypass, which allows refrigerant, previously stored in the accumulator during the heating cycle, to be quickly withdrawn and put into circulation where it may deliver heat to the outdoor coil, does not necessarily reduce defrost times. It has been found that, while such a system may quickly melt the frost on the coil, the low resistance bypass to the expansion valve is not conducive to raising the temperature of the outdoor coil to the desired defrost termination temperature which may be as high as 80° to 85° F.

One proposed solution to this problem is set forth in commonly assigned U.S. Pat. No. 4,429,552, "Refrigerant Expansion Device" to Wayne R. Reedy. The '552 patent recognizes that the low pressure differential upon initiation of defrost results in less than a desirable amount of refrigerant flow through the refrigerant expansion device. An expansion device made from a shape memory alloy is provided which is capable of providing two different expansion bores, depending on the temperature of the refrigerant flowing through the device. A larger bore size serves as the expansion device during the first portion of the defrost cycle and the device then changes to a smaller bore size responsive to an increase in temperature later in the defrost cycle.

A refrigerant expansion device that is capable of responding to certain pressure and flow conditions to provide an optimum expansion area within the device for such pressure and flow conditions is disclosed and claimed in commonly assigned U.S. patent application, Ser. No. 473,481, filed on Feb. 1, 1990, entitled, "Variable Area Refrigerant Expansion Device".

The '481 application discloses a refrigerant metering device having a housing with a flow passage extending therethrough. Mounted within the housing is a piston having a flow metering port extending axially therethrough. The piston is mounted such that it is movable within the flow passage. An elongated member is also provided within the housing and extends into the metering port of the piston. The elongated member and the metering port cooperate to define a flow metering passage between them. The elongated member is configured such that the cross-sectional area of the flow metering passage varies in relation to the position of the elongated member to the flow metering port. Means are provided for supporting the elongated member within the housing and for controlling the axial position of the elongated member and the piston with respect to one another as a function of the differential pressure across the flow metering piston.

SUMMARY OF THE INVENTION

The present invention recognizes the complex thermodynamic changes occurring in a heat pump system during the defrost mode of operation and provides for a refrigerant expansion device capable of responding to these conditions to minimize the length of the defrost cycle.

Upon initiation of a defrost cycle the frosted outdoor coil will not allow saturation temperatures of the refrigerant within the coil higher than about 32 to 40 degrees F. This is due to the phase change of frost to water, i.e., all of the heat transferred to the outdoor coil is used up as the latent heat of fusion as the frost melts to become water, at a constant temperature. During this time, to quickly melt the frost, it is desirable to maximize the refrigerant flow rate through the expansion device. When frost is melting, and the temperature of the outdoor coil is low, the differential pressure between the high and the low side of the system is extremely low. The expansion device of the present invention provides an expansion area, in response to the low pressure differential, which offers almost no resistance to refrigerant flow. As a result, refrigerant previously stored in the accumulator during the heating cycle is quickly withdrawn, due to the high mass flow, and put into circulation where it may deliver heat to the outdoor coil.

Once the frost on the outdoor coil is melted, the pressure, and thus saturation temperature of refrigerant within the coil, will automatically rise since the frost is now gone, and the mechanism for maintaining constant temperature is also gone. At this point in a defrost cycle the goal is to raise the temperature of the outdoor coil to the desired termination temperature as quickly as possible. To aid in raising the outdoor coils temperature, it has been recognized that it is now preferred to begin restricting the refrigerant flow through the expansion device to the outdoor coil, thus forcing a higher condensing pressure and temperature. The expansion device of the present invention causes this to happen. As the pressure differential across the expansion device rises, the device further restricts the refrigerant flow therethrough. The amount of restriction may be tailored to each system, since the taper or tapers on the refrigerant rod may be designed to optimize the restriction at each different pressure differential the defrost cycle will see.

It is an object of the present invention to provide a refrigerant expansion device that is able to respond to pressure differentials across the device to provide a variable expansion area which is optimum for both defrost cycle and normal cooling cycle operation.

It is another object of the present invention to minimize the length of the defrost cycle of a heat pump system.

These and other objects of the present invention are attained by a refrigerant expansion device including a housing having a flow passage extending therethrough. A piston having a flow metering port therethrough is moveably mounted within the flow passage. A flow metering rod is supported within the housing and extends through the metering port. The flow metering rod and the flow metering port cooperate to define a variable area flow metering passage therebetween. The flow metering rod is configured so that the cross sectional area of the flow metering passage varies relative to the axial position of the piston with respect to the rod. The piston is spring biased to a closed position on the rod when no refrigerant is flowing through the device. The piston moves against the bias of the spring as a function of the pressure differential between the high and low pressure side of a refrigeration system in which the device is installed. The cross sectional area of the flow metering rod is configured to define a defrost zone. The defrost zone cooperates with the metering port of the piston to provide a defrost flow metering passage, at pressure differentials which are lower than the normal pressure differential range for cooling operation of the system in which the device is to be installed. The flow metering passage defined by the defrost zone of the rod and the flow metering port is substantially larger than the flow metering passage required for cooling operation of the refrigeration system.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DESCRIPTION OF THE PREFERRED EMBODIMENT

Figure 1:
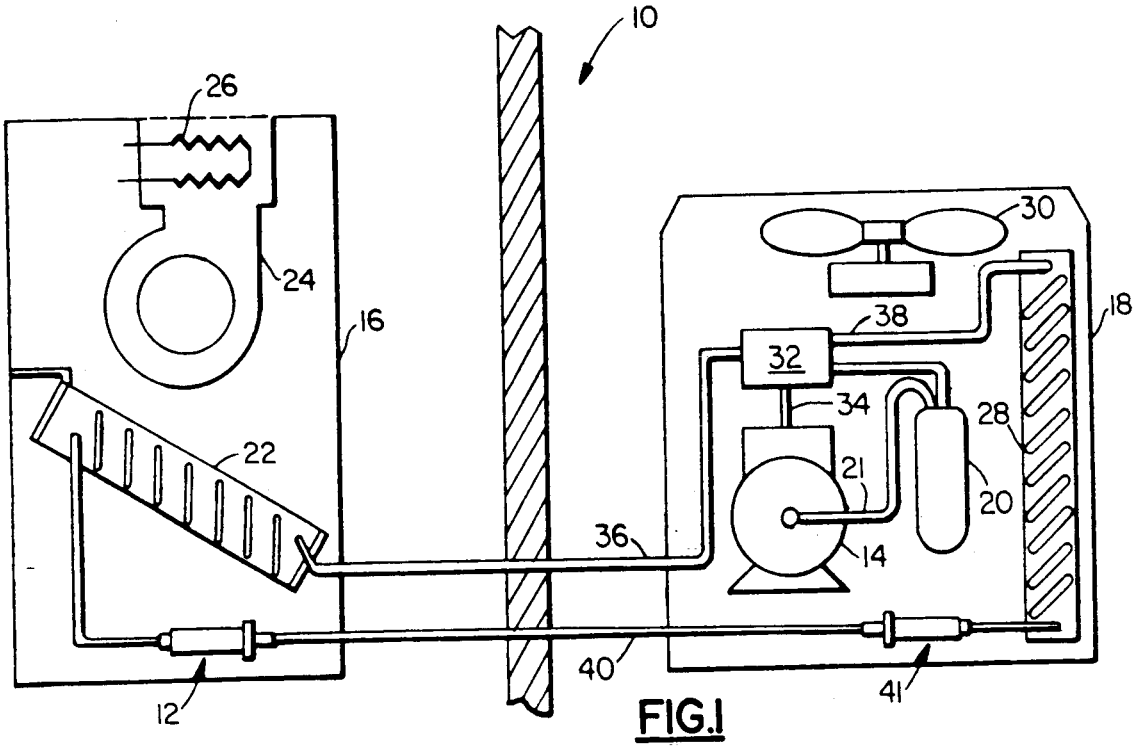
FIG. 1 is a schematic diagram of a heat pump system making use of an expansion device according to the present invention.

With reference first to FIG. 1, numeral 10 designates a heat pump of substantially conventional design, but having a mechanical cooling/defrost expansion valve 12 according to the present invention. The cooling/defrost expansion valve operates to provide an optimum expansion area during the full range of cooling operation of the system as well as during the defrost mode of operation of the system. The operation of the cooling-/defrost expansion valve will be described in full detail hereinbelow.

The heat pump 10 also includes a compressor 14, an indoor heat exchanger assembly 16 and outdoor heat exchanger 18. An accumulator 20 is provided in the compressor suction line 21. The indoor heat exchanger assembly 16 includes a refrigerant-to-air heat exchange coil 22 and an indoor fan 24. The indoor assembly is also shown with a back up electrical resistance heating coil 26. The outdoor heat exchanger assembly 18 includes a refrigerant-to-air heat exchange coil 28 and an outdoor fan 30. The indoor and outdoor heat exchangers are of conventional design and will not be described further herein.

A four way reversing valve 32 is connected to the compressor discharge port by a refrigerant line 34, to the compressor suction port (via accumulator 20) by suction line 21 and to coils 22 and 28 by refrigerant lines 36 and 38, respectively. The reversing valve 32 is also of conventional design for directing high pressure refrigerant vapor from the compressor to either the indoor coil 22, in the heating mode of operation, or, during the cooling mode and defrost mode, to the outdoor coil 28. Regardless of the mode of operation, the reversing valve 32 serves to return refrigerant from the coil operating as an evaporator to the compressor 14.

A refrigerant line 40 interconnects the indoor coil 22 and the outdoor coil 28. The aforementioned cooling-/defrost expansion valve 12 is located in the refrigerant line 40 within the indoor heat exchanger assembly 16 adjacent to the indoor coil 22. A second expansion valve 41, designed to optimize operation of the system during the heating mode of operation, is located at the other end of the refrigerant line 40 within the outdoor heat exchange assembly 18 adjacent to the outdoor coil 28. The heating expansion valve 41 is of the bypass type which is configured to meter refrigerant flowing to the outdoor coil 28 when the system is in the heating mode of operation and to allow a free substantially unrestricted bypass flow of refrigerant therethrough when refrigerant is flowing in the other direction during the cooling and defrosting modes of operation. The structure of the cooling/defrost expansion valve 12 will now be described in detail followed by a description of the operation of the valve in the cooling and defrost modes of operation, and a description of the operational advantages of a system which is equipped with the cooling-/defrost expansion valve of the invention.

Turning now to FIGS. 2–7, it will be seen that the cooling/defrost expansion valve 12 comprises a generally cylindrical body 42 which defines a cylindrical elongated chamber 44 in the interior thereof. Extending from the left hand end of the body 42 is a threaded nipple 46 having a fluid passageway 48 formed therein which communicates the interior chamber 44 with the exterior thereof. The right hand end of the body 42 is open ended and has a male thread 50 formed on the exterior thereof. The open end of the body 42 is closed by an end cap 52 which has interior threads 54 which mate with the threads 50 on the body. A nipple 56, having a fluid passageway 57 therethrough extends outwardly from the end cap 52. The fluid passagewayS 48 and 57 of the nipples 46 and 56, respectively, together with the interior chamber 44, define a flow passage through the expansion device. A circular washer 59 is mounted within the end cap 52 and cooperates with the end of the body 42 to establish a fluid tight seal therebetween.

A three legged spider-like element, hereinafter referred to as the spring retainer 58, is supported within the interior chamber 44 by cooperation between the end cap 52 and an interior groove 60 formed in the interior surface of the open right hand end of the body 42. Because the retainer has three legs, only one of the legs 62 is shown in the drawing figures as being clamped in the described position by these elements. The spring retainer 58 also includes a central portion 64 through which a threaded opening 66 extends.

Figure 4:
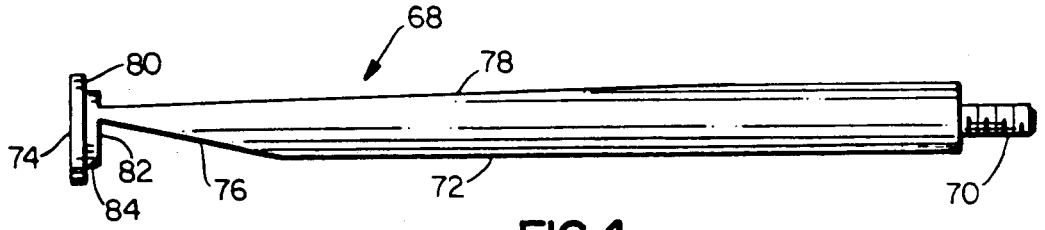
FIG. 4 is an enlarged longitudinal view of the metering rod of the expansion device of FIGS. 2 and 3.
Figure 5:
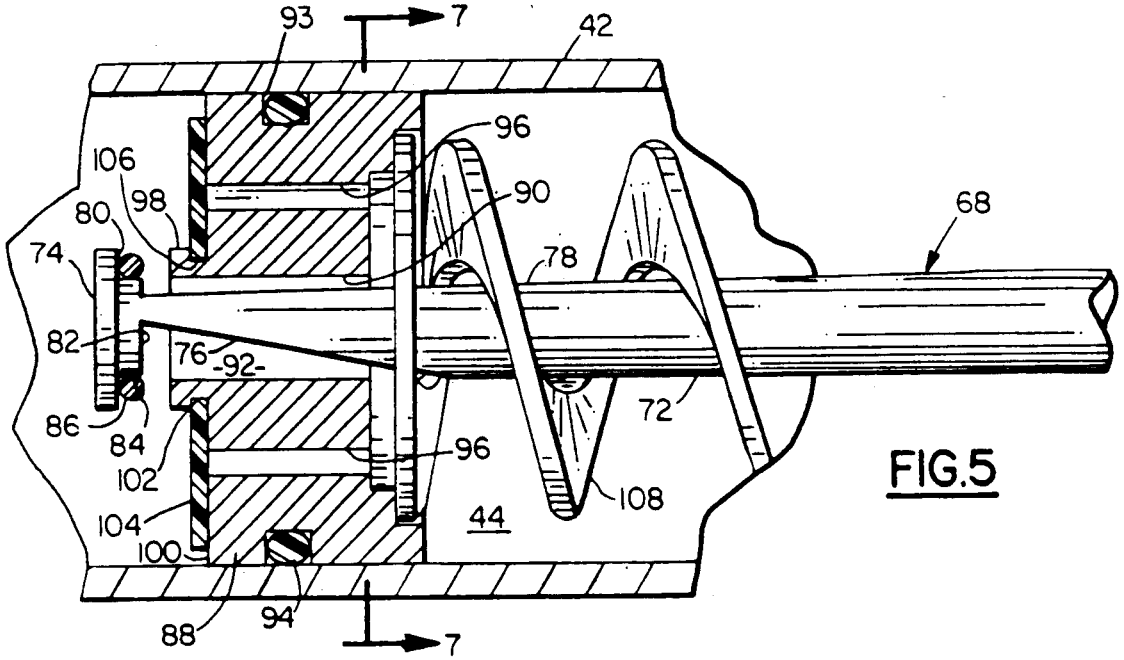
FIG. 5 is an enlarged longitudinal sectional view of the metering rod and refrigerant metering piston of the device of FIGS. 2 and 3 during the defrost mode of operation.

Mounted to the spring retainer 58 in a cantilever fashion is a refrigerant metering rod 68. The refrigerant metering rod includes a reduced diameter threaded portion 70 which is adapted to be received within the threaded opening 66 in the spring retainer 58. Extending from its attachment to the spring retainer 58 the refrigerant metering rod comprises a flow metering geometry bearing section 72, and terminates in an enlarged end portion 74. The configuration of the flow metering geometry portion is best shown in FIGS. 4 and 5 where it is seen that the cross sectional area of the rod 68 originates at a minimal value adjacent the enlarged end 74 and progresses through a region, identified by the reference numeral 76 formed on the under side of the rod 68, known as the defrost taper region. On the upper side of the refrigerant metering rod 68 a second taper, referred to as the cooling mode taper extends from the same region of minimal cross sectional area adjacent the enlarged end 74 to a region of maximum diameter near the right hand end of the rod. The cooling taper is identified by reference numeral 78.

The enlarged end portion 74 of the rod 68 defines an annular planar surface 80 facing to the right as viewed in the drawing figures. The enlarged end 74 has a stepped down portion 82 of reduced diameter which defines an outwardly facing surface 84, perpendicular to the surface 80. The surfaces 80 and 84 together cooperate to receive and support a metering rod seal 86. The seal 86 is made from a material which will swell or otherwise seal when exposed to a refrigerant to assure retention of the seal in the described position. A neoprene O-ring has performed satisfactorily.

Reference numeral 88 designates a flow metering piston which is generally cylindrical in shape and has a flow metering port 90 extending axially therethrough. The flow metering port 90 is of such a size that the flow metering geometry bearing section of the rod 68 is readily received therein to allow free relative axial movement of the piston 88 with respect to the rod 68. The space defined between the flow metering port 90 and the flow metering bearing portion 72 of the rod 68 will hereinafter be referred to as the flow metering passage 92. The interaction between these components will be described in detail hereinbelow in connection with the description of the cooling and defrost modes of operation of a heat pump system.

The outside diameter of the piston 88 is such that the piston is received within the interior chamber 44 of the body 42 with a clearance allowing free axial motion of the piston with respect to the body. An annular groove 93 is machined into the outside surface of the piston and a suitably sized O-ring 94 is adapted to be received therein in a manner such that it cooperates with the groove 92 and the inside surface of the chamber 44 to preclude refrigerant flow between those components when the device is in operation in a heat pump system. The piston 88 also includes a plurality of fluid flow openings 96 extending therethrough which are parallel with the flow metering port 90.

As best shown in FIG. 5, a centrally located, reduced diameter boss 98 extends from the left hand facing end surface 100 of the flow metering piston 88. The boss 98 has an annular groove 102 defining an area of reduced diameter formed therein immediately adjacent the left hand facing surface 100. The groove 102 is adapted to receive and retain a washer shaped flexible seal element 104 having a central opening therethrough 106 which is adapted to be received in and retained by the groove 102. The outer diameter of the seal 104 is slightly less than the outside diameter of the piston 88. This seal 104 is adapted to overlie each of the plurality of fluid flow openings 96 and to prevent refrigerant flow through these openings when refrigerant is flowing through the device 12 from left to right as viewed in the drawing figures and to readily allow refrigerant flow therethrough when the flow is from right to left. In the preferred embodiment the seal 104, which is basically a check valve, is fabricated from a synthetic resin such as teflon.

The boss 98 cooperates with the enlarged end 74 of the rod and the O-ring 86 to limited the motion of the piston 88 to the left. Further, the O-ring seal 86 engages the boss 98 on the piston to establish a fluid-tight seal between the rod and the piston when the piston is urged into contact with the O-ring as will be hereinafter appreciated.

A refrigerant metering spring 108, comprising a helically wound spring is disposed within the expansion valve body 42 in coaxial relationship with the metering rod 68. The ends of the spring 108 engage the spring retainer 58, on the right, and the right hand facing end surface of the refrigerant metering piston 88 on the left. In the preferred embodiment, the spring is partially compressed between the spring retainer 58 and the piston to preload the refrigerant metering assembly. This preloading is accomplished during the assembly of the device by threading the spring retainer 58 onto the threaded end 70 of the metering rod 68 thereby compressing the spring to the desired level of preload. Following this, a lock nut 110 is threaded on the end 70 of the rod to securely lock the retainer in the desired preload position. A lock washer (not shown) may be used to insure a positive connection therebetween.

As previously discussed in connection with FIG. 1 the refrigerant line 40 extending between the indoor coil 22 and the outdoor coil 28 of the heat pump system is provided with a cooling/defrost expansion valve 12, according to the present invention, in the indoor heat exchange assembly 16, and, with a heating expansion valve 41 within the outdoor heat exchanger assembly 18. Because the operation of the cooling/defrost expansion valve 12 during the defrost mode of operation is actually a special case mode of cooling operation of the system, the cooling and heating modes of operation will be briefly summarized prior to an explanation of the operation of the cooling/defrost expansion valve during a complete defrost cycle.

Figure 2:
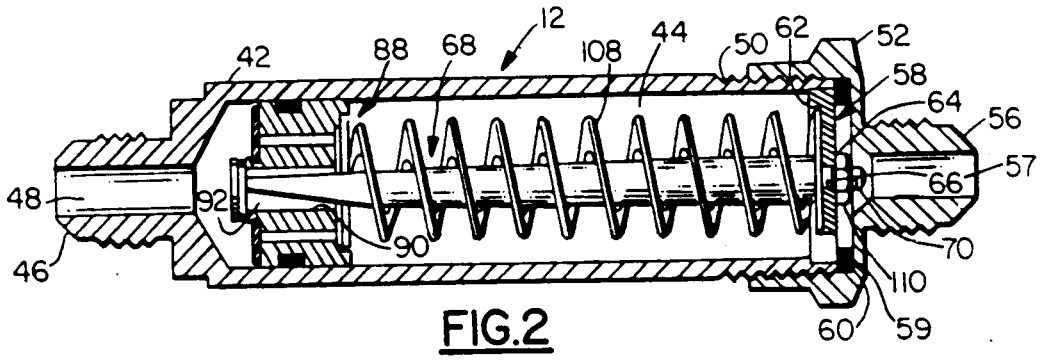
FIG. 2 is a longitudinal sectional view through an expansion device according to the present invention.

Referring to FIG. 2 the cooling/defrost expansion valve 12 is shown in a static no-flow condition. As shown, the spring 108 has been pre-loaded (as described above) and, urges the piston 88 into fluid tight engagement with the O-ring 86 carried by the rod 68 (also as described above). As a result, no refrigerant may flow through the flow metering passage 92 until the force on the piston, due to operation of the refrigeration system, exceeds the force on the piston exerted by the preloaded spring. As a result of the above-described positive shut-off feature, the expansion device 12 is capable of preventing refrigerant migration from the high pressure side to the low pressure side when the system in which it is installed is shut off. It also follows that the system is able to maintain a pressure differential between the high and low side when the system is off. A direct benefit of this is that Degradation Coefficient CD of the refrigeration system is reduced. The Degradation Coefficient is a termed defined by the U.S. Department of Energy that relates to the measure of the efficiency loss of the system due to the cycling of the system.

The preload of the spring also sets what is referred to as the system threshold pressure differential. Once set by suitable pre-loading of the spring, this pressure differential must be reached in the system before the expansion device will begin to allow the flow of refrigerant therethrough.

At the start of a cooling cycle, the reversing valve 32 has been positioned so that the outdoor coil 28 functions as a condenser coil and the indoor coil 22 functions as an evaporator. At the start of a cooling cycle, the pressure differential across the cooling/defrost expansion valve 12 will begin to develop, with the high side being to the left of the piston 88 and the low side to the right. As the pressure differential across the piston develops, it urges the piston to move to the right against the force of the spring 108. When the pressure differential exceeds the force exerted by the preloaded spring, i.e., the threshold pressure differential of the system is exceeded, and refrigerant begins to flow through the variable area flow metering passage 92 between the flow metering rod 68 and the flow metering port 90. The pressure differential within the system develops quickly, and, the piston 88 moves to the right rapidly to a position along the rod 68 which is representative of positions associated with the range of pressure differentials experienced by the system during normal cooling operation. Specifically it should be noted that, upon initiation of a cooling cycle, the piston moves quickly, through and beyond the defrost taper region 76 of the rod 68. This occurs so rapidly that no effect on the normal cooling operation of the system is experienced as a result of the large expansion area which the device provides when the piston is in the defrost region 76 of the rod.

Figure 3:
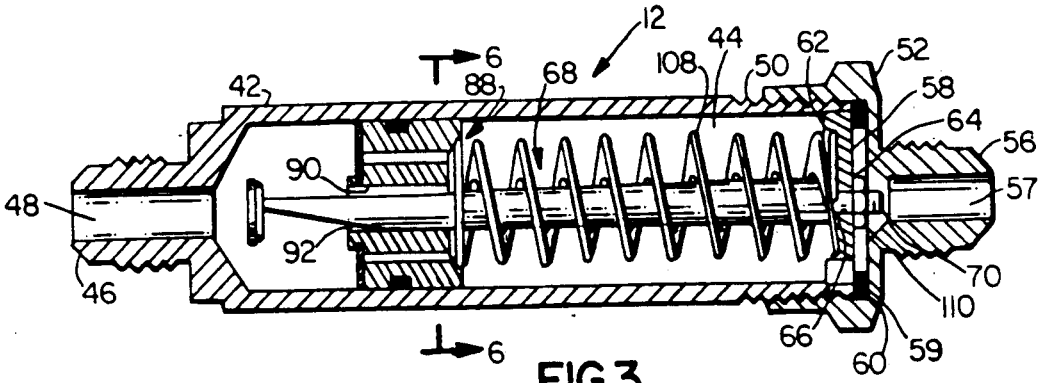
FIG. 3 is a longitudinal sectional view of the expansion device of FIG. 2 showing operation of the device while in the normal cooling mode of operation.
Figure 6:
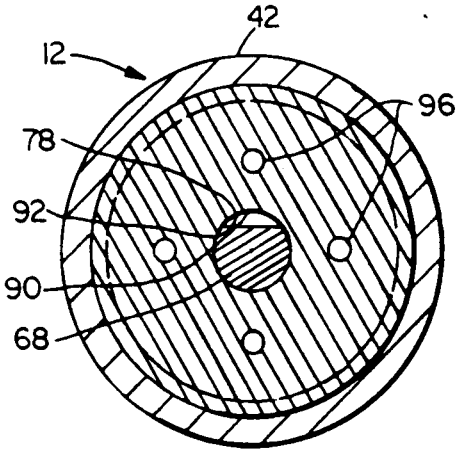
FIG. 6 is an enlarged sectional view of the expansion device taken along the lines 6—6 of FIG. 3.
Figure 7:
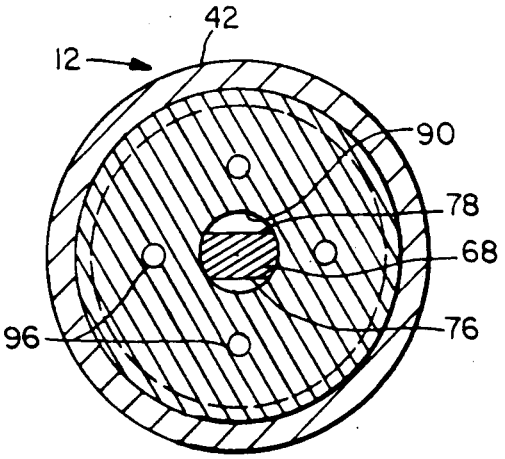
FIG. 7 is an enlarged sectional view of the expansion device taken along the lines 7—7 of FIG. 5.

FIG. 3 illustrates the cooling/defrost expansion device 12 as it appears in operation with an intermediate pressure drop, e.g., about 150 psi, across the piston. With reference to FIG. 6 it will be noted that the variable area flow metering passage 92 is defined by a single segment defined between the cooling taper 78 of the rod 68 and the flow metering port 90.

As a general rule, in controlling the flow of refrigerant in the cooling mode of operation, it has been found that the cross sectional area of the cooling taper 78 of the rod 68 should progress from a smaller value at the left hand thereof to a larger cross sectional area as the right hand end of the rod is approached. The relationship thus established is that the flow metering passage 92 is larger at lower pressure differential and decreases as the pressure differential across the piston 88 increases.

Looking now, briefly, at the heating mode of operation, the setting of the reversing valve 32 is changed. As a result, hot gaseous refrigerant is discharged from the compressor 14 to the reversing valve 32 which directs the hot gaseous refrigerant to the indoor coil 22 which is now operating as a condenser and rejecting heat to the indoor space being heated. From the indoor condenser 22 the refrigerant is directed via refrigerant line 40 to the outdoor heat exchange assembly 18 where it passes through the heating mode expansion device 41 and thence to the outdoor coil 28 which now serves as an evaporator.

As described above, during heating operation, under appropriate outdoor temperature and humidity conditions moisture from the outdoor air collects on the outdoor coil fins in the form of frost which interferes with heat transfer through the coil by blocking air flow therethrough. As discussed above, a defrost cycle is a special case cooling cycle of the system and, as a result of the initiation of a defrost cycle the four way valve 32 is reversed thereby reversing the flow of refrigerant through the system such that the discharge from the compressor is now directed through the outdoor coil 28 which is now operating as a condenser and from that coil the refrigerant is directed, via the refrigerant line 40, to the cooling/defrost expansion valve 12 and thence to the indoor coil 22 now serving as an evaporator.

Again, as described above, upon initiation of a defrost cycle the primary goal is to get into circulation within the system the proper amount of refrigerant, in the proper places, to maximize heat transfer from the conditioned space to the cold frosted outdoor coil 28. The conditions existing in prior art heat pump systems are not conducive to this goal. Specifically, as set forth above the condensing pressure in the outdoor coil 28 is the maximum pressure available for delivering refrigerant, from the outdoor coil to the indoor coil, through the cooling expansion device. Under such circumstances the cooling expansion device normally exhibits a high resistance to flow thereacross because it is designed to control refrigerant flow at a high pressure differential. Under such circumstances the compressor may struggle to reduce the pressure in the indoor coil to less than zero in order to establish a pressure differential capable of feeding the indoor coil. Again, as set forth above, in some systems, under certain circumstances, a satisfactory defrost cycle cannot be accomplished with the cooling expansion device serving as the defrost expansion valve.

In the present system, upon initiation of a defrost cycle the pressure differential across the cooling/defrost expansion valve 12 is extremely low as in prior art systems, however, the expansion valve 12 is designed to provide a very large flow metering passage 92 therethrough at the low pressure differentials that exist during the initial stages of a defrost cycle. FIG. 5 shows the condition of the cooling/defrost expansion valve 12 in the defrost flow metering condition wherein the threshold pressure differential of the system has just been overcome and the piston 88 has moved only slightly to the right with the respect to the rod 68. In this position, the defrost taper 76 of the refrigerant metering rod 68, as well as the left hand end of the normal cooling taper 78 of the rod 68, together cooperate with the flow metering port 90 of the piston to define the above described large defrost expansion area 92.

As pointed out above, upon initiation of the defrost cycle the frosted outdoor coil 28 will not allow saturation temperatures of the refrigerant within the coil higher than about 32 to 40 degrees F. This is due to the phase change of frost to water. During this time, therefore, to quickly melt the frost, it is desirable to maximize the refrigerant flow rate through the expansion device and the entire system.

When the frost on the outdoor coil is melting, and the temperature of the outdoor coil is low, the pressure difference between the high and low sides of the system is extremely low. When these conditions exist the expansion device 12 automatically provides an expansion area 92, in response to this low pressure differential, which offers almost no resistance to refrigerant flow. As a result of this large defrost expansion area, refrigerant previously stored in the accumulator 20, during the heating cycle, is quickly withdrawn, due to the high mass flow, and put into circulation where it may quickly deliver heat to the frosted outdoor coil 28.

In a typical system there might be two pounds of frost on an outdoor coil 28 which weighs 15 pounds. Under these conditions, with the heat of fusion of ice being 143 btu per pound, and the refrigerant freely flowing through the large defrost expansion area of the valve 12, the ice will be melted in 1 to 2 minutes.

Once the frost on the outdoor coil 28 is melted, the saturation temperature and the pressure of the refrigerant therein, will automatically rise since the frost is now gone, and the mechanism for maintaining constant temperature is also gone. At this point in a defrost cycle, in order to minimize the defrost time, the goal is to raise the temperature of the outdoor coil 28, to the desired termination temperature, as quickly as possible. To aid in achieving this goal, at this point in a defrost cycle, it is preferred to have a smaller refrigerant expansion area.

The cooling/defrost expansion device 12 accomplishes this by sensing the increase in temperature and pressure of the outdoor coil and adjusts the expansion area accordingly. Stated more concisely, as the pressure differential across the expansion device rises, the device operates to automatically restrict the refrigerant flow therethrough. This restriction of refrigerant flow, through the expansion device 12 to the outdoor coil, will thus act to force even higher condensing pressures and temperatures as quickly as possible to thereby minimize overall defrost cycle time. The amount of restriction of an expansion device 12 may be tailored to each system in which a device is to be used. This is easily accomplished because the taper or tapers on the refrigerant rod may be designed to optimize the restriction at each pressure differential the defrost cycle of a system will see.

As an example, for a typical heat pump system, the system threshold pressure differential (i.e. as set by the spring pre-load) may be about 30 psi. In such a case, upon the initiation of a defrost cycle the device will begin metering through the defrost taper zone 76 of the refrigerant metering rod 68 at a pressure differential of 30–35 psi. This condition, is as illustrated in FIG. 5. In this system, pressure differential upon termination of defrost will be about 140 psi. At this point, the system would be shifted to the heating mode and refrigerant metering would take place through the heating expansion device. For &:his typical system, the normal pressure differential range for cooling operation would be about 75 psi to 200 psi.

In this typical system, it should be appreciated that the drastically improved defrost metering operation, which takes place when the defrost taper is controlling expansion, will occur in the range of approximately 30–35 psi up to about 75 psi. at this point the piston moves into the normal cooling region of the rod. During the latter stages of defrost, where the piston is in the normal cooling region however, the system will be operating to raise the temperature of the outdoor coil to the desired termination temperature, thereby further facilitating shortening of the defrost cycle as described in detail herein above. In a typical system the configuration of the defrost metering zone is such that it meters refrigerant for a pressure differential range of about 10–50 psi before the flow metering passage cross sectional area moves into the range of normal cooling operation.

Accordingly it should be appreciated that a refrigeration expansion device has been provided that has a variable expansion area operated by the pressure differential between the high and the low sides of a heat pump system and which is capable of providing an optimum expansion area during the flow range of pressure differentials of both the cooling and defrost modes of operation.

This invention may be practiced or embodied in still other ways without departing from the spirit or essential character thereof. The preferred embodiment described herein is therefor the lustrative and not restricted, the scope of the invention being indicated by the appended claims in all variations which come within the meeting of the claims are intended to be embraced therein.

What is claimed is:

1. A refrigerant expansion device of the type including:

a housing having a flow passage extending therethrough, a piston, having a flow metering port therethrough, movably mounted within the flow passage, a flow metering rod supported within the housing and extending through the metering port, the flow metering rod and the flow metering port cooperating to define a flow metering passage therebetween, the flow metering rod having a varying cross-sectional area is configured so that the cross sectional area of the flow metering passage varies relative to an axial position of the piston with respect to the rod, the piston is spring biased to a closed position on the rod when no refrigerant is flowing through the device, and, the piston moves relative to the rod as a function of a pressure differential between a high and low pressure side of a refrigeration system in which the device is installed, wherein the improvement comprises;

configuring the cross sectional area of said flow metering rod to define a defrost zone which cooperates with said metering port to provide a flow metering passage, at pressure differentials lower than a normal pressure differential range for cooling operation of the system in which the device is to be installed, which is substantially larger than the flow metering passage required for cooling operation of the refrigeration system.

2. The apparatus of claim 1 wherein the expansion device includes means for preloading the spring bias of the piston to set a system threshold pressure differential, and, wherein said defrost zone is configured to meter refrigerant through said substantially larger flow metering passage for a pressure differential increase in a range of 10–50 psi before the flow metering passage cross sectional area moves into a range of normal cooling operation.

* * * * *